United States Patent [19]

Findley

[11] 4,192,364

[45] Mar. 11, 1980

[54] LOG SPLITTING DEVICE

[76] Inventor: Charles A. Findley, 7006 Rowland, Kansas City, Kans. 66109

[21] Appl. No.: 912,499

[22] Filed: Jun. 5, 1978

[51] Int. Cl.[2] ..... B27L 7/00

[52] U.S. Cl. ..... 144/193 A

[58] Field of Search ..... 144/3 K, 193 R, 193 A, 144/323; 125/23 R, 23 C

[56] References Cited

U.S. PATENT DOCUMENTS

| | | | |
|---|---|---|---|
| 846,839 | 3/1907 | Peterson | 144/193 A |
| 2,657,681 | 11/1953 | Gatzke | 125/23 R |
| 3,077,214 | 2/1963 | Brukner | 144/193 A |
| 3,280,864 | 10/1966 | Spanenberg | 144/193 A |
| 3,319,675 | 5/1967 | Bles, Sr. | 144/193 A |
| 3,596,691 | 8/1971 | Broadfoot | 144/193 A |

FOREIGN PATENT DOCUMENTS

| | | | |
|---|---|---|---|
| 1042220 | 10/1958 | Fed. Rep. of Germany | 144/193 A |

*Primary Examiner*—Robert Louis Spruill
*Assistant Examiner*—W. D. Bray
*Attorney, Agent, or Firm*—John A. Hamilton

[57] ABSTRACT

A log splitting device comprising a frame on which two aligned wedges are respectively fixed and movably mounted, a support for positioning a log to be split between the wedges, and a manually operably hydraulic jack for advancing the movable jaw toward the fixed jaw, whereby said log is split.

8 Claims, 3 Drawing Figures

LOG SPLITTING DEVICE

Figures 1, 2, 3:
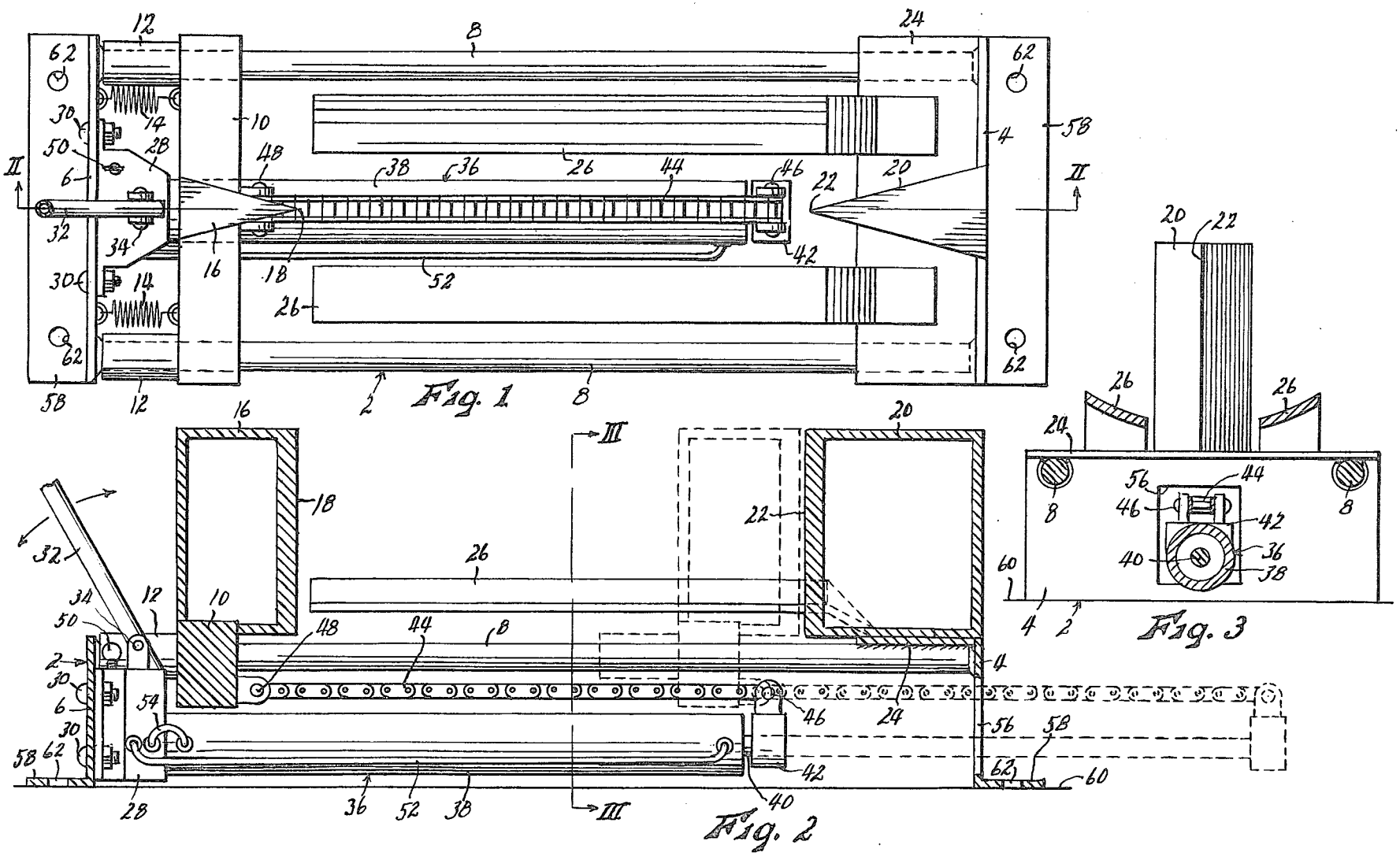

This invention relates to new and useful improvements in devices for splitting logs, particularly for use in fireplaces. Fireplace logs, while usually supplied in acceptable and generally uniform lengths, are often so thick as to require splitting for more economical usage and more efficient burning. The splitting operation is tedious and laborious, and often dangerous to unskilled persons attempting it, unless special equipment is used, and such equipment within my knowledge being quite expensive up to the present time. The provision of a log splitting device which is economical, safe, convenient and physically easy to operate is the overall object of the present invention.

A more specific object is the provision of a log splitting device having means for supporting a log in parallel relation to the motion of a movable wedge, and supported against a backstop, and hydraulic means for moving the wedge to enter and split the log.

Another object is the provision of a log splitting device of the character described in which the backstop also comprises a wedge cooperating with the first wedge. In this manner, whichever wedge may enter the log with the least force, due to arrangement of the wood grain, may perform the actual splitting, or if one wedge should strike a knot or other "hard spot" in the log, then the other wedge can advance in the log. Thus the splitting may be accomplished with a minimum of force required.

Other objects are simplicity and economy of manufacture and efficiency and dependability of operation.

With these objects in view, as well as other objects which will appear in the course of the specification, reference will be had to the accompanying drawing, wherein:

FIG. 1 is a top plan view of a log splitting device embodying the present invention, shown in its rest position, FIG. 2 is a sectional view taken on line II—II of FIG. 1, with parts left in elevation, showing the movable wedge in its rest position in solid lines, and in an advanced position in dotted lines, with parts omitted, and FIG. 3 is a sectional view taken on line III—III of FIG. 2.

Like reference numerals apply to similar parts throughout the several views, and the numeral 2 applies generally to the frame of the log splitting device forming the subject matter of the present invention, said frame consisting of front and rear vertical end plates 4 and 6 rigidly interconnected by a pair of parallel, horizontally spaced apart slide rods 8 extending between and affixed at their ends to said end plates. Said slide rods are arranged horizontally, and a cross head 10 is slidably mounted thereon for forward and rearward movement. Said cross head extends horizontally between said slide rods, and is provided with a rearward extension sleeve 12 slidably engaged on each of said slide rods, whereby to reduce any possibility of binding of the cross head on said slide rods, and to limit rearward movement of said cross head relative to rear end plate 6. Said cross head is biased resiliently to the rear at all times by a pair of tension springs 14 extending between and connected at their opposite ends respectively to said cross head and said end plate.

A rear wedge 16 is affixed as by welding to cross head 10 at the longitudinal midline of the device. The cutting edge 18 of said wedge is disposed vertically, and extends above the cross head to a distance generally as great as the diameter of a log the device may be expected to split. Rear wedge 16 cooperates with a front wedge 20 the cutting edge 22 of which faces rearwardly, and is generally parallel to and longitudinally coextensive with edge 18 of rear wedge 16. Front wedge 20 is affixed at its lower end, as by welding, to a horizontal plate 24 overlying and welded to the forward portions of slide rods 8, and to front end plate 4. Welded to plate 24 are a pair of elongated support members 26. Said support members are offset upwardly adjacent plate 24, and extend rearwardly in parallel relation, at opposite sides of the midline of the device, to a point adjacent rear wedge 16 when the latter is in its rest position. Said support members are adapted to support a log to be split, not shown, between the confronting cutting edges of the wedges, with the axis of the log disposed horizontally and lying generally in the vertical midplane of the device. The upper surface of the log support formed conjointly by members 26 is arcuately concave as best shown in FIG. 3, in order to prevent the log from rolling transversely. Members 26 are disposed sufficiently high that cross head 10 may move forwardly therebeneath, and are spaced laterally far enough apart that rear wedge 16 may pass therebetween, when the cross head is driven forwardly by means presently to be described.

A hydraulic pump 28 is affixed to the forward face of rear end plate 6, as by bolts 30, and is manually operated by forward and rearward reciprocation of a handle 32 pivoted thereto at 34, as indicated in FIG. 2. Said pump operates a hydraulic ram 36 including a hydraulic cylinder 38 affixed to and extending horizontally forwardly from the pump body, below and midway between slide rods 8, it being understood that said cylinder carries a piston fixed to a piston rod 40 which extends forwardly from the cylinder and has a head member 42 affixed to its extended end. A tension member 44, which may for example constitute a flexible chain, is connected at its forward end to head 42, as at 46, then extends rearwardly above cylinder 38 in parallel relation thereto, being connected at its rearward end to cross head 10, as at 48. Pump 28 is provided with a manually operable control valve 50. It will be understood that when valve 50 is set in one position, reciprocation of handle 32 causes pump 28 to draw oil from the forward end of cylinder 38 through a conduit 52, and to deliver said oil under pressure to the rearward end of the cylinder through conduit 54, thereby forcing the cylinder piston, piston rod 40 and head 42 forwardly, thereby exerting tension on chain 44 to draw cross head 10 and wedge 16 forwardly. When valve 50 is manually set in another position, the ends of the cylinder are hydraulically connected, so that the rearward bias of springs 14 on cross head 10 moves wedge 16 rearwardly and reacts through chain 44 to retract piston rod 40 into cylinder 38, thereby causing the oil to return to the forward end of the cylinder. The hydraulic system of the pump and cylinder are standard and well known in the art, and hence are not here shown in full detail. They may in fact constitute a standard hydraulic jack such as is commonly used for automotive purposes and the like, and many types of such standard hydraulic jacks may be adapted for use in the present device.

The advancement of wedge 16 by the hydraulic jack system advances piston rod 40, head 42 and chain 44 through the plane of front end plate 4, and said front end plate is provided with an aperture 56 permitting their passage. Also, each of the end walls is provided at its lower edge with a flange 58 which rests on a floor 60, and said flanges may be provided with apertures 62 for receiving screws, bolts or the like for anchoring the device to said floor.

In general operation, a log is rested on supports 26 as previously described, with rear wedge 16 in its rearmost position, the spacing of the wedges at this time being such as to receive logs of standard fireplace lengths therebetween, so that said log is positioned endwise between the cutting edges of the two wedges. Then valve 50 is set so that reciprocation of handle 32 operates pump 28 to advance piston rod 40, head 42, chain 44, cross head 10 and rear wedge 16 forwardly, whereby the log is split between the two wedges. After the log is split, valve 50 is reset to allow rearward return of wedge 16 by springs 14, also as previously described, and the device is ready to receive another log to be split.

A special feature of the present invention is the use of two cooperating wedges between which a log is split, rather than a single wedge movable toward a fixed backstop, not a wedge and usually planar, as is customary in prior log splitting devices within my knowledge. The use of two wedges eases and facilitates the splitting operation, often reducing the force required from ram 36 to perform the splitting. Each wedge acts as a backstop for the log, against which the log is pressed by the other wedge. While it is true that a given force will be required to force either wedge into the log, whether the backstop against which that wedge is pressing the other end of the log is another wedge or merely a flat, planar surface, it is also true that with any given log, a wedge may enter one end thereof more easily than the other, and with less force required, due to the hardness, wetness, grain arrangement or other variable factors at the respective ends of the log. In the present device, therefore, as the pressure from the hydraulic ram builds up, whichever wedge can enter the log with the lesser force will actually do so, with the other wedge serving primarily as a mere backstop, rather than as an actual cutting or splitting tool. It will also be apparent that the wedge which is actually moving through the log (or over which the log is being moved) as thus for described, may strike a knot, a swirl or disarrangement of the wood grain pattern, or other "hard spot" in the log, offering a greater resistance to movement of that wedge through the log. If this occurs, and if the resultant requirement for additional wedge force is sufficiently great, then that wedge becomes the backstop for the other wedge, and said other wedge enters the log (or the log begins to move relative to said other wedge) to begin splitting said log from its opposite end. Generally, a log may be split more easily and with less force in this manner, that is, from both ends, than would be required to force a single wedge through "hard spots" such as are commonly encountered in many logs.

While I have shown and described a specific embodiment of my invention, it will be readily apparent that many minor changes of structure and operation could be made without departing from the spirit of the invention.

I claim:

1. A log splitting device comprising:

a. a frame, b. a pair of confronting knife edged wedges having generally parallel cutting edges carried by said frame, one of said wedges being fixed relative to said frame and the other of said wedges being movable relative to said frame in a direction normal to the cutting edges of said wedges, c. support means on said frame for supporting a log in endwise relation between said wedges, and d. power means carried by said frame and operable to move said movable wedge toward said fixed wedge, whereby said log is split from either or both ends.

2. A device as recited in claim 1 wherein said power means comprises a manually operable hydraulic ram.

3. A device as recited in claim 2 wherein said hydraulic ram is operable to drive said movable wedge toward said fixed wedge and includes means whereby it may be deactivated to permit free movement of said movable wedge, and with the addition of means resiliently biasing said movable wedge away from said fixed wedge.

4. A device as recited in claim 1 wherein said frame includes a pair of rigid guide rods extending parallel to the direction of movement of said movable wedge, a cross head on which said movable wedge is affixed being slidably mounted on said guide rods for movement therealong, said power means being operable to move said cross head along said guide rods toward said fixed wedge.

5. A device as recited in claim 4 with the addition of means operable effectively to disconnect said power means from said cross head whereby to permit free movement thereof along said guide rods, and springs yieldably biasing said cross head in a direction away from said fixed wedge.

6. A device as recited in claim 4 wherein said power means comprises:

a. a hydraulic ram fixed in said frame and including a hydraulic cylinder having a piston and piston rod operatively mounted therein, b. a connector joining said piston rod to said cross head, and c. a manually operable hydraulic pump operable to pump hydraulic fluid from one end of said cylinder to the other, whereby to drive the piston of said cylinder in a direction to advance said cross head toward said fixed wedge.

7. A device as recited in claim 6 with the addition of:

a. manually operable valve means operable to interconnect the ends of said cylinder hydraulically whereby to permit free movement of the piston therein, and b. resilient means biasing said cross head yieldably in a direction away from said fixed wedge.

8. A device as recited in claim 6 wherein said hydraulic cylinder extends generally between said wedge, though laterally offset therefrom, and said piston rod when extended projects beyond said fixed wedge, said piston rod being connected to said cross head by a tensile member extending parallel to and in part coextensively with said cylinder, whereby the required overall length of said device, in a direction parallel to the movement of said movable wedge, is reduced.

* * * * *